United States Patent [19]

Spinner et al.

[11] 4,267,531

[45] May 12, 1981

[54] HIGH-FREQUENCY TERMINATING IMPEDANCE

[76] Inventors: Georg Spinner, 8152 Feldkirchen-Westerham 1, Am Eichberg 12; Manfred Lang, 80 21 Taufkirchen, Veilchenweg 63, both of Fed. Rep. of Germany

[21] Appl. No.: 40,479

[22] Filed: May 18, 1979

Related U.S. Application Data

[63] Continuation-in-part of Ser. No. 821,407, Aug. 3, 1977, abandoned.

[30] Foreign Application Priority Data

Aug. 3, 1976 [DE] Fed. Rep. of Germany ..... 2634812

[51] Int. Cl.[3] ..... H01P 1/26

[52] U.S. Cl. ..... 333/22 R; 338/217

[58] Field of Search ..... 333/22 R, 81 A; 338/138, 216, 217, 306–309, 333

[56] References Cited

U.S. PATENT DOCUMENTS

| | | | |
|---|---|---|---|
| 3,336,558 | 8/1967 | Wright | 338/217 |
| 3,354,412 | 11/1967 | Steidlitz | 333/22 R |
| 3,582,842 | 6/1971 | Friedman | 338/216 X |
| 3,634,789 | 1/1972 | Stuckert | 333/81 A X |
| 3,761,846 | 9/1973 | Tsuboi | 338/216 X |

*Primary Examiner*—Paul L. Gensler

*Attorney, Agent, or Firm*—Mason, Fenwick & Lawrence

[57] ABSTRACT

The invention relates to an HF terminating impedance in strip conductor technique in which the resistive layer is enclosed between two ceramic plates which are clamped from the outside by metallic heat dissipating plates, the freedom from reflection of the terminating impedance being ensured by the lateral edge lines of the resistive layer satisfying the condition $$Z_L(x) = Z_L - \int_0^x R dx$$

To ensure an intimate heat conduction contact between the resistive layer and the ceramic plates and the ceramic plates and the adjoining clamping plate without introducing bending stresses into the ceramic plates which might cause fracture, at the contact surfaces a soft metal foil, preferably of lead, is inserted which is prevented from cold flow by a rolled-in grating or netting, in particular of bronze or copper. The ceramic plates may be made plane parallel (for smaller powers) or wedge-shaped, by which the advantage can be achieved that per unit length substantially the same power density is obtained and because of the favorable heat dissipation via the ceramic plates and the metal plates clamping them a high permanent power can be taken up with compact construction.

8 Claims, 9 Drawing Figures

HIGH-FREQUENCY TERMINATING IMPEDANCE

This application is a continuation-in-part application out of earlier application Ser. No. 821,407 of Aug. 3, 1977, now abandoned.

The invention relates to an HF terminating impedance in the form of a homogeneous strip line which effects a correct characteristic impedance termination. The strip conductor of constant thickness is covered on both sides by a dielectric which in turn is enclosed by metal plates which form the screen or are in connection with the outer conductor of the coaxial system. Such an arrangement is known from U.S. Pat. No. 3,354,412. In the latter, the strip conductor comprises over the entire length a constant cross-section so that the condition necessary for a correct characteristic terminating impedance can only be fulfilled if the outer boundary between dielectric and outer conductor is given a predetermined form. This complicated shaping can be realized when using dielectric materials which are cast or can easily be shaped in another manner. However, the aim of the invention is to use ceramic materials with which such complicated shaping is not possible.

U.S. Pat. No. 3,634,789 discloses an attenuator in which the known condition as regards keeping the characteristic impedance constant is fulfilled by the lateral edge lines having a predetermined path. However, in this case the dielectric support is only on one side of the strip conductor.

It is an object of the invention to provide an HF terminating impedance in strip conductor technique which can be subjected to high loads, ensures a low reflection in a very wide frequency range and is compact.

A further object of the invention is to provide an HF terminating impedance which comprises a resistive layer connected between two ceramic plates which are clamped from the outside by metallic heat dissipating plates, the freedom from reflection of the terminating impedance being ensured by the fact that the lateral edge lines of the resistive layer satisfy the condition.

$$Z_L(x) = Z_L - \int_0^x R dx$$

A further object of the invention is to ensure an intimate thermal conductive contact between the resistive layer and the ceramic plates and the ceramic plates and the adjacent clamping plate without subjecting the ceramic plates to bending stresses which could cause fracture.

A further object of the invention is to insert at the contact faces a soft metal foil preferably of lead which is prevented from cold flow by a rolled-in grating, in particular of bronze or copper.

A further object of the invention is to provide a HF terminating impedance in which the ceramic plates are made plane parallel, thus providing an optimum configuration with compact structure for lower powers.

A further object of the invention is to provide an HF terminating impedance in which per unit length substantially the same power density is obtained and the ceramic plates are made wedge-shaped, thus enabling a high permanent power to be taken up with compact design.

Some examples of the invention will be described hereinafter with the aid of the drawings, wherein.

Figure 1:
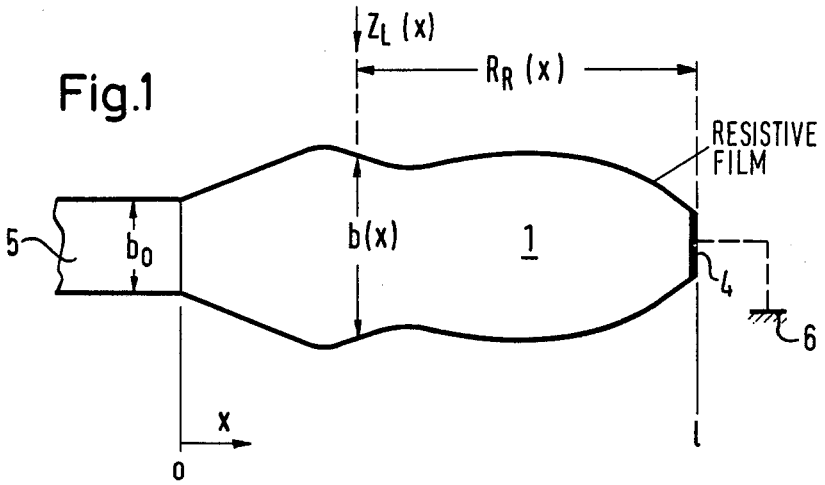
FIG. 1 shows a general illustration of the problem which quantities must be incorporated as a function of x and dependent on the local dielectric constant.

FIG. 1 of the drawings represents one possible form of a resistive film. This figure is intended only to illustrate the terms such as $R_R$ (x) and $Z_L$ (x) as they are employed in the description. A quite general arbitrary impedance form is shown. To fulfil the aforementioned characteristic impedance condition this layer would require a dielectric with variable thickness.

The input line 5 with the width $b_o$ feeds the resistive film 1 which starts at the point x=0 and extends to the right in the direction of the X axis where at the end of the layer via a conductor 4 a connection is established to the screening 6 or the outer conductor of the coaxial system. In FIGS. 2 to 7, representing all examples of embodiment of the invention, the reference numeral 1 denotes the resistive film, the numerals 2 and 3 the dielectric in the form of ceramic plates and 4 represents the connection between the end of the resistive film and the screening 6 which bears on the dielectric on the outside. 5 is the input line.

Figure 2:
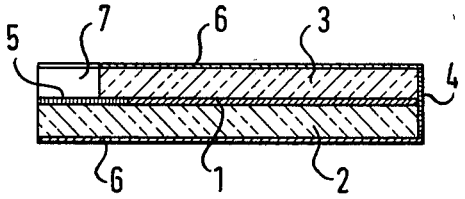
FIG. 2 is a diagrammatic view of a terminating impedance having an exponentially widening resistive layer, then continued with constant width, in section along the line II—II of FIG. 3.
Figure 3:
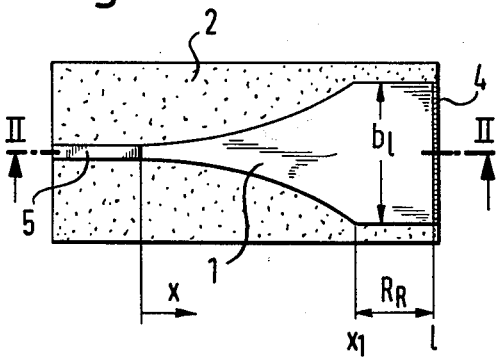
FIG. 3 shows a diagrammatic plan view of the terminating impedance illustrated in FIG. 2 with the upper dielectric removed.
Figure 6:
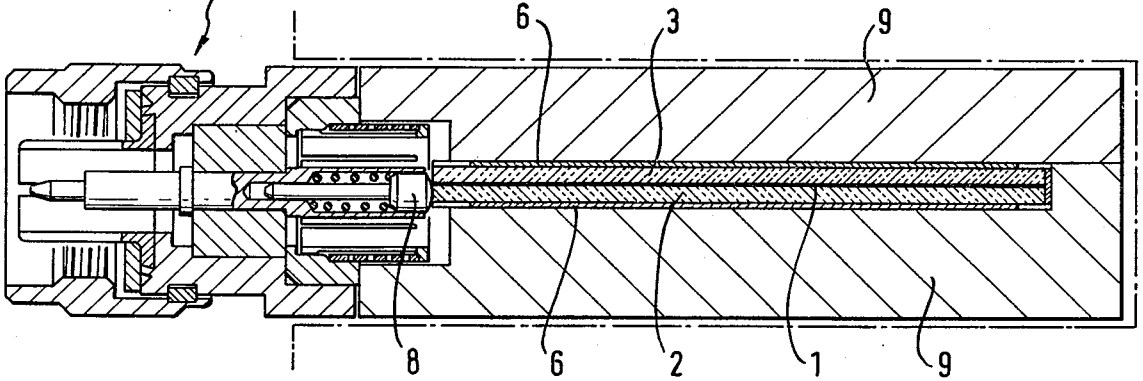
FIG. 6 shows a terminating impedance corresponding to the embodiment of FIGS. 2 and 3 with coaxial line terminal in a sectional view corresponding to FIG. 2.

FIGS. 2, 3 and 6 represent a terminating impedance for a permanent power of about 25 watts.

The symbols used in the description and drawings have the following meaning:

$Z_L$: characteristic impedance of the line, i.e. the resistive film $R_R$(x): residual impedance at the point x, i.e. between x and the end 1

$b_o$: width of the input line = width of the resistive film at the point x=0 b(x): width of resistive film at the point x

Do: total thickness of dielectric at x=0

Dx: total thickness of dielectric at the point x.

FIG. 2 represents a cross-section, the thickness D (x) of the dielectric 2 and 3 remaining constant. On a dielectric support 2 there is a resistive film 1 and the input line 5 and conductive connection 4 for the screening 6, which is also applied fixedly to one side of the dielectric.

A second dielectric plate or wafer 3, which is provided with a screening 6 and a contacting 4 as well as a recess 7 for compensation, completes the terminating impedance. The recess 7 serves to compensate a capacitive component which arises due to the connection of the terminating impedance to a necessary terminal line (e.g. coaxial line).

FIG. 3 shows a plan view of the resistive film or layer, the upper dielectric 3 being removed. Up to the point $x=x_1$ the condition $Z_L(x)=R_R(x)$ is fulfilled at every point x.

From $x=x_1$ to $x=1$ the resistive layer has a constant width $b_1$. This step does not result in any appreciable impairment of the reflection factor if $Z_L(x_1) \leqq Z_L(o)/10$.

Any necessary terminating balancing of the impedance can be provided by grinding longitudinal grooves in the resistive layer in the region from $x=x_1$ to $x=1$.

Since a major part of the entire power in such impedances is converted to heat near the junction from the input line to the resistive layer, according to a further development of the invention the form of the resistive layer is so chosen that it has a favourable width variation from the thermal point of view. This is possible by suitable choice of the thickness variation of the dielectric. However, for purely production technical reasons it is desirable for $D_{(x)}$ to be linearly dependent on x.

Figure 4:
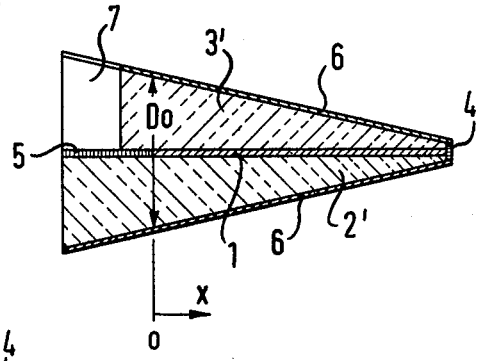
FIG. 4 shows in section diagrammatically a further embodiment of a terminating impedance sectioned along the line IV—IV of FIG. 5.
Figure 5:
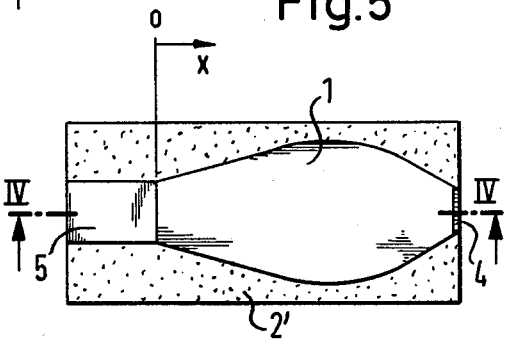
FIG. 5 shows a diagrammatic plan view of the terminating impedance of FIG. 4 with the upper dielectric removed.
Figure 7:
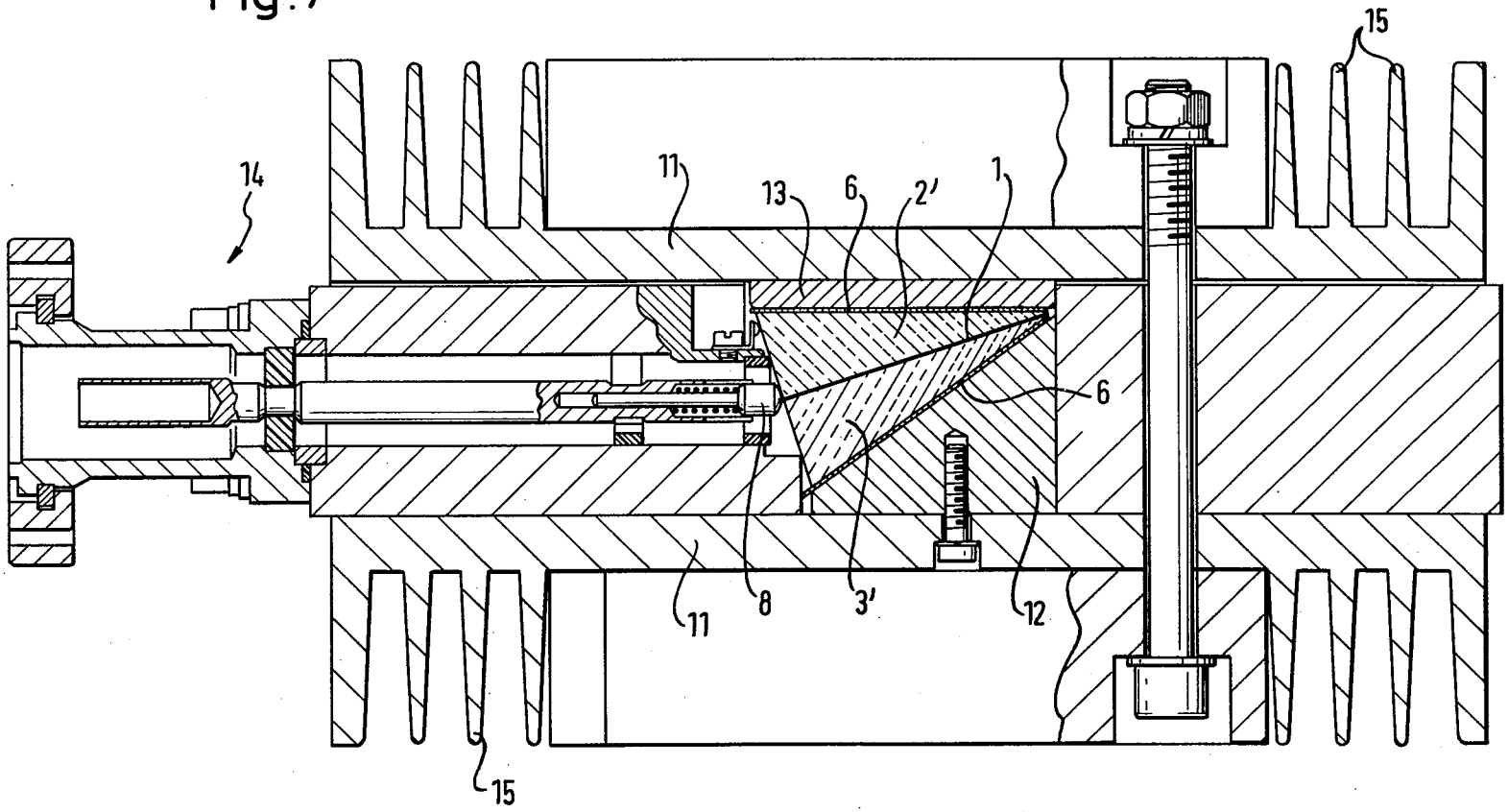
FIG. 7 shows a terminating impedance corresponding to the embodiment of FIGS. 4 and 5 with coaxial line terminal in a sectional view corresponding to FIG. 4.

A cross-section through such a terminating impedance for greater permanent powers of about 600 watts is shown in FIGS. 4, 5 and 7.

The dielectric 2', 3' is wedge-shaped. The thickness $D_{(x)}$ is governed by the following equation:

$$D_{(x)}=D_{(o)}-cx$$

In this expression, c is a constant valve dependent on the characteristics of the dielectric material.

Under this condition, the resulting shape for the resistive layer is substantially shown in FIG. 5. For this shape the condition $Z_L(x)=R_R(x)$ applies without restriction and this permits excellent reflection values up to very high frequencies.

Due to the close contact of the resistive layer 1 with the dielectric covering plates or wafers very high heat transfer values may be obtained. If the metallic screening 6 is in turn brought into fixed contact with a cooling system of some form and if the dielectric used is a ceramic material of good heat conduction (e.g. BeO), the terminating impedances described can deal with very high powers without the maximum permissible temperature being exceeded anywhere in the resistive layer.

Possible cooling systems are:

(a) directly fitted convection coolers, (b) directly fitted heat exchangers which are cooled with gas or liquids, (c) open vapour cooling systems, (d) closed vapour cooling systems (heat pipe).

FIG. 6 shows a constructional solution of the terminating impedance according to FIGS. 2 and 3.

The ceramic wafer 2 carries the resistive layer 1 of Cr/Ni. The outline of this layer corresponds to that shown in FIG. 3.

To enable optimum dissipation of the thermal energy forming in the resistive layer a second ceramic wafer 3 is disposed on the layer side. This provides a symmetrical distribution of the heat flow emanating from the resistive layer, i.e. the load to which such an arrangement can be subjected is approximately twice as high as with a construction in which the resistive layer is exposed on one side.

The two wafers 2 and 3 are pressed together with the aid of two metal plates 9 which act as cooling surfaces to obtain the highest possible heat transfer factors between the different layers. To keep the ceramic plates free from mechanical stresses as far as possible a lead foil 6 is inserted as screening between the cooling surfaces and the ceramic wafers 2, 3. For improved heat transfer all surfaces are coated with heat conducting grease.

A contact point at the end face of the ceramic wafer 2 is connected to the input line 5 so that the supply of the HF energy can take place via the illustrated resilient end contact 8 of the inner conductor of a coaxial line, a terminal plug 10 of which is shown in FIG. 6.

The terminating impedance shown in FIG. 6 has overall dimensions of 93 mm×36 mm×42 mm and can be subjected to a permanent power of 25 W, the reflection being less than 6% in the frequency range 0 . . . 3 GHz. If additional cooling tabs are applied to the cooling surfaces the permanent loadibility may be increased to 250 W. The terminating impedance illustrated differs from the constructions hitherto by the form of the resistive layer and the symmetric arrangement of the dielectric. The latter permits particularly good dissipation of the heat energy from the inside to the outside.

FIG. 7 shows a constructional embodiment of the terminating impedance according to FIGS. 4 and 5.

A ceramic wedge 2' is provided on the major cathetus face with a resistive layer 1. The outline of this layer corresponds to that shown in FIG. 5.

To enable optimum dissipation of the thermal energy forming in the resistive layer 1 a further ceramic wedge 3' lies with its major cathetus face on the layer. This provides a symmetrical distribution of the heat flow emanating from the resistive layer 1. i.e., such an arrangement can be subjected to approximately twice the load as an arrangement in which the resistive layer on one side is exposed.

The two wedges 2' and 3' are pressed together with the aid of two cooling bodies 11 with cooling ribs 15. The members 12 and 13 have the function of fitting pieces. To keep the ceramic wedges free from mechanical stresses as far as possible lead foils 6 are inserted between the fitting pieces 12 and 13. To improve the heat transfer all surfaces are coated with heat conducting grease.

The asymmetrical form of the insert is for production technical reasons to enable one of the fitting pieces 13 to be made as plane parallel plate, only the other fitting piece 12 having to be made as prism.

The input line 5 continues up to the smaller cathetus face so that there with the aid of an axially resilient end contact 8 of a coaxial terminal line 14 the HF energy can be transmitted.

The HF terminating impedance shown in FIG. 7 has the total dimensions 256 mm×256 mm×119 mm and can be subjected to a permanent power of 600 W, the reflection being less than 5% in the frequency range from 0 . . . 2 GHz.

Figure 9:
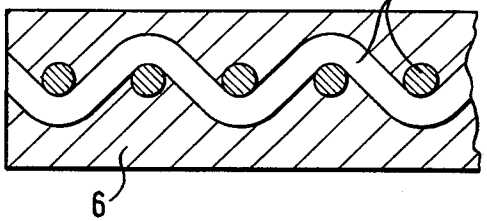
FIG. 9 is a section along the line IV—IV of FIG. 8.
Figure 8:
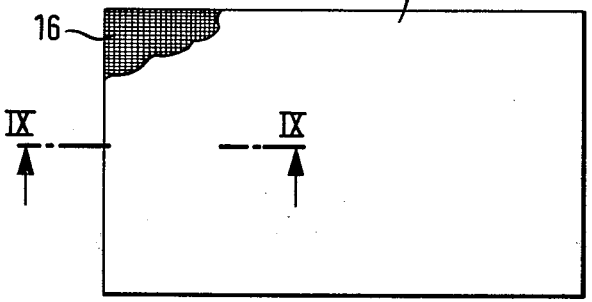
FIG. 8 is a view of the hardened foil with grating disposed between ceramic plates and metal plates.

In FIGS. 6 and 7, as conductor covering of the ceramic plates soft metal foils 6, for example of lead, are provided which even when the adjoining faces are not exactly in planar position avoid excessive stress to the ceramic material and, compensating the pressure, guarantee a substantially constant surface application. Such soft metals tend to cold flow when they are permanently subjected to high pressures. This cold flow of the soft metal foils 6 must be prevented so that the desired and set application pressure can be maintained. This is done by reinforcing the metal foil 6 by a grating 16 of a metallic electrical conductor, in particular copper or bronze. As shown in FIG. 8 and FIG. 9 the grating 16 is in the form of netting with its intersecting weft and warp filaments embedded into the metal foil 6, which is conveniently done by placing a prefabricated grating on the metal foil 6 and rolling the grating into said foil on passage through two squeezer rolls.

What we claim is:

1. A high-frequency terminating impedance comprising a resistive layer of constant thickness which is disposed on a dielectric support and the lateral edge lines of which extend such that the condition $$Z_L(x) = Z_L - \int_o^x R\,dx \text{ is fulfilled,}$$

wherein $Z_L$: characteristic impedance of the line $Z_L(x)$: characteristic impedance into the resistive layer at the point (x)

R: remaining resistance between the point (x) and the end of the resistive layer, an axially resilient contact of the inner conductor of a coaxial terminal bearing at the end face on a contact which is disposed on the end face of the dielectric support, the resistive layer being disposed between two ceramic plates forming the dielectric and the ceramic plates in turn being in intimate contact with and clamped by metal plates which are in electrical contact with the end of the resistive layer, the ceramic plates having the same thickness, and the terminating impedance including a soft metal foil inserted between the metallic clamping plates and said ceramic plates, the impedance further including a pair of fitting pieces inserted between the ceramic plates and the metallic clamping plates, one of said fitting pieces being made as a plane plate and the other fitting piece forming a wedge member, the two wedge-shaped ceramic plates with the resistive layer disposed therebetween being arranged inclined with respect to the conductor axis of the coaxial conductor, and the soft metal foil being traversed by a metallic grating which prevents a lateral cold flowing of the soft metal.

2. A high-frequency terminating impedance comprising a resistive layer of constant thickness which is disposed on a dielectric support and the lateral edge lines of which extend such that the condition $$Z_L(x) = Z_L - \int_o^x R\,dx \text{ is fulfilled,}$$

wherein $Z_L$: characteristic impedance of the line $Z_L(x)$: characteristic impedance into the resistive layer at the point (x)

R: remaining resistance between the point (x) and the end of the resistive layer, an axially resilient contact of the inner conductor of a coaxial terminal bearing at the end face on a contact which is disposed on the end face of the dielectric support, the resistive layer being disposed between two ceramic plates forming the dielectric and the ceramic plates in turn being in intimate contact with and clamped by metal plates which are in electrical contact with the end of the resistive layer, the ceramic plates having a wedge-shaped longitudinal section and tapering toward the impedance end, and the impedance including a soft metal foil inserted between the metallic clamping plates and the ceramic plates, the impedance further including a pair of fitting pieces inserted between the ceramic plates and the metallic clamping plates, one of said fitting pieces being made as a plane plate and the other fitting piece forming a wedge member, the two wedge-shaped ceramic plates with the resistive layer disposed therebetween being arranged inclined with respect to the conductor axis of the coaxial conductor, and the soft metal foil being traversed by a metallic grating which prevents a lateral cold flowing of the soft metal.

3. A high-frequency terminating impedance comprising a resistive layer of constant thickness which is disposed on a dielectric support and the lateral edge lines of which extend such that the condition $$Z_L(x) = Z_L - \int_o^x R\,dx \text{ is fulfilled,}$$

wherein $Z_L$: characteristic impedance of the line $Z_L(x)$: characteristic impedance into the resistive layer at the point (x)

R: remaining resistance between the point (x) and the end of the resistive layer, an axially resilient contact of the inner conductor of a coaxial terminal bearing at the end face on a contact which is disposed on the end face of the dielectric support, the resistive layer being disposed between two ceramic plates forming the dielectric and the ceramic plates in turn being in intimate contact with and clamped by metal plates which are in electrical contact with the end of the resistive layer, the ceramic plates having the same thickness, and the terminating impedance including a soft metal foil inserted between the metallic clamping plates and said ceramic plates, the soft metal foil being traversed by a metallic grating which prevents a lateral cold flowing of the soft metal.

4. A terminating impedance as set forth in claim 3, wherein said foil is a lead foil and said metallic grating consists of copper.

5. A terminating impedance as set forth in claim 3, wherein said foil is a lead foil and said metallic grating consists of copper beryllium.

6. A high-frequency terminating impedance comprising a resistive layer of constant thickness which is disposed on a dielectric support and the lateral edge lines of which extend such that the condition $$Z_L(x) = Z_L - \int_o^x R\,dx \text{ is fulfilled,}$$

wherein $Z_L$: characteristic impedance of the line $Z_L(x)$: characteristic impedance into the resistive layer at the point (x)

R: remaining resistance between the point (x) and the end of the resistive layer, an axially resilient contact of the inner conductor of a coaxial terminal bearing at the end face on a contact which is disposed on the end face of the dielectric support, the resistive layer being disposed between two ceramic plates forming the dielectric and the ceramic plates in turn being in intimate contact with and clamped by metal plates which are in electrical contact with the end of the resistive layer, the ceramic plates having a wedge-shaped longitudinal section and tapering toward the impedance end, and the impedance including a soft metal foil inserted between the metallic clamping plates and the ceramic plates, the soft metal foil being traversed by a metallic grating which prevents a lateral cold flowing of the soft metal.

7. A terminating impedance as set forth in claim 6, wherein said foil is a lead foil and the metal grating consists of copper.

8. A terminating impedance as set forth in claim 6, wherein said foil is a lead foil and the metal grating consists of copper beryllium.

* * * * *